United States Patent [19]

Hirata et al.

[11] Patent Number: 4,753,158

[45] Date of Patent: Jun. 28, 1988

[54] PILOT HYDRAULIC SYSTEM FOR OPERATING DIRECTIONAL CONTROL VALVE

[75] Inventors: Toichi Hirata, Ushiku; Genroku Sugiyama; Shinichi Satoh, both of Ibaraki, all of Japan

[73] Assignee: Hitachi, Construction Machinery Co., Ltd., Tokyo, Japan

[21] Appl. No.: 904,119

[22] Filed: Sep. 5, 1986

[30] Foreign Application Priority Data

Sep. 6, 1985 [JP] Japan ..... 60-135597[U]
Sep. 6, 1985 [JP] Japan ..... 60-135598[U]

[51] Int. Cl.[4] ..... F15B 9/08

[52] U.S. Cl. ..... 91/461; 91/463; 60/463; 60/468

[58] Field of Search ..... 60/493, 468, 463; 91/461, 443, 463; 137/504

[56] References Cited

U.S. PATENT DOCUMENTS

| | | | |
|---|---|---|---|
| 3,094,042 | 6/1963 | Diener | 91/463 |
| 3,319,648 | 5/1967 | Donner | 137/504 |
| 4,194,365 | 3/1980 | Stoufflet et al. | 60/468 |

*Primary Examiner*—Larry I. Schwartz
*Attorney, Agent, or Firm*—Antonelli, Terry & Wands

[57] ABSTRACT

A pilot hydraulic system comprises a directional control valve having at least one pilot chamber for controlling the operation of a hydraulic actuator; and a pilot valve connected through a pilot line to the pilot chamber of the directional control valve for operation thereof. The pilot line includes a flow control valve which allows a free flow of hydraulic fluid from the pilot valve to the directional control valve while limiting a flow of hydraulic fluid from the directional control valve to the pilot valve.

9 Claims, 4 Drawing Sheets

PILOT HYDRAULIC SYSTEM FOR OPERATING DIRECTIONAL CONTROL VALVE

BACKGROUND OF THE INVENTION

1. Field of the Invention

The present invention generally relates to a pilot hydraulic system for operating a directional control valve adapted to control the operation of a hydraulic actuator. More specifically, the invention pertains to a pilot hydraulic system for operating a directional control valve which is suitable for incorporation in various working machines, such as hydraulic excavators, in which an inertial body acts upon the hydraulic actuator as a load.

2. Description of the Prior Art

In general, various types of working machines, such as hydraulic excavators, are equipped with appropriate hydraulic actuators. Such a working machine is commonly arranged to accomplish its predetermined motion by driving these hydraulic actuators in a suitable manner. Such hydraulic actuators are controlled by the directional control valves which ar driven through the operation of operating levers. In recent days, it has been proposed that the pilot operating system in which a directional control valve is driven by a pilot pressure. Generally speaking, such a conventional pilot operating system includes a pilot hydraulic system in which, as an example, a pair of pilot chambers are disposed at opposing ends of the directional control valve, with the pilot chambers being connected through pilot lines to a pilot valve operated by an operating lever.

The operation of such a prior-art pilot hydraulic system will be described below, with reference to a directional control valve for controlling the motion of a travel motor incorporated in the hydraulic excavator.

When an operator shifts the operating lever from its neutral position, a hydraulic fluid from a pilot hydraulic pump is made to flow through the pilot valve connected to the pilot hydraulic pump. This fluid is made to flow into one of the pilot lines, and is supplied to the pilot chamber of the directiohal control valve through pilot line. This inflow switches the directional control valve to a predetermined operating position which allows the flow of hydraulic fluid from a main hydraulic pump to the corresponding one of the two main lines through the directional control valve, so that the fluid is delivered to the travel motor connected to the main lines. After the fluid has completed its predetermined work within the travel motor, it is made to pass through the other of the main lines, returning to a reservoir through the directional control valve. The above-described sequence of hydraulic flow causes the rotation of the travel motor, and the hydraulic excavator is thereby made to travel.

When the operator returns the operating lever to the neutral position to stop the hydraulic excavator, the pilot valve first cuts off the communication between the pilot pump and the former of the pilot lines and this pilot line forms communication with the reservoir. The thus-formed communication allows the hydraulic fluid within the former pilot chamber of the directional control valve to flow back into the reservoir. Consequently, when the directional control valve is shifted to the neutral position, the supply of fluid from the main pump to the travel motor is interrupted and the main lines are closed. In the meantime, the travel motor does not immediately stop and will continue to rotate by inertial force. While the motor is rotating, it absorbs hydraulic fluid from the former main line and discharges the fluid to the latter main line. Therefore, the hydraulic pressure within the closed main line sharply increases, and the thus-increased pressure serves as brake pressure, thereby stopping the travel motor.

However, in such a prior-art hydraulic system, when the operating lever is returned to the neutral position, the directional control valve tends to restore to the neutral position remarkably quickly. Thus, the brake pressure generated within the latter main line shows a remarkably sharp rise, and also an extremely large impact is applied to the entire body of the hydraulic excavator when it is stopped. For this reason, the prior-art hydraulic system has generally involved various drawbacks, such as inferior operability of the system, a high level of operator fatigue, and deterioration of the operability of the mechanism. Such problems occur in various conventional types of hydraulic actuators used in the above-described hydraulic excavators and other working machines. In particular, as the load acting upon the hydraulic actuator shows a higher level of inertia, the influence of these problems over the entire mechanism becomes greater.

SUMMARY OF THE INVENTION

Accordingly, it is an object of the present invention to provide a novel and improved pilot hydraulic system for operating a directional control valve in which the above-described disadvantages of the prior art can be eliminated and in which it is possible to reduce the level of impact generated when the hydraulic actuator is stopped, thereby enabling improvements in operability and durability, and also a reduction in operator fatigue.

To this end, according to the present invention, a pilot hydraulic system is provided which comprises:

a directional control valve having at least one pilot chamber for controlling the operation of a hydraulic actuator; and a pilot valve connected through a pilot line to the pilot chamber of the directional control valve for operation thereof, wherein the pilot line includes a flow control valve which allows a free flow of hydraulic fluid from the pilot valve to the directional control valve while limiting a flow of hydraulic fluid from the directional control valve to the pilot valve.

The above and other objects, features and advantages of the present invention will become apparent from the following description of the preferred embodiments thereof, taken in conjunction with the accompanying drawings.

BRIEF DESCRIPTION OF THE DRAWINGS

FIG: 1 is a side elevational view schematically showing a hydraulic excavator which represents a typical example of a working machine incorporating a pilot hydraulic system which operates a directional control valve in accordance with the present invention.

DESCRIPTION OF PREFERRED EMBODIMENTS

Preferred embodiments of a pilot hydraulic system for controlling a directional control valve in accordance with the present invention will be described hereinbelow, with illustrative reference to several examples in which the embodiments of this invention are applied to the hydraulic excavator.

Figure 1:
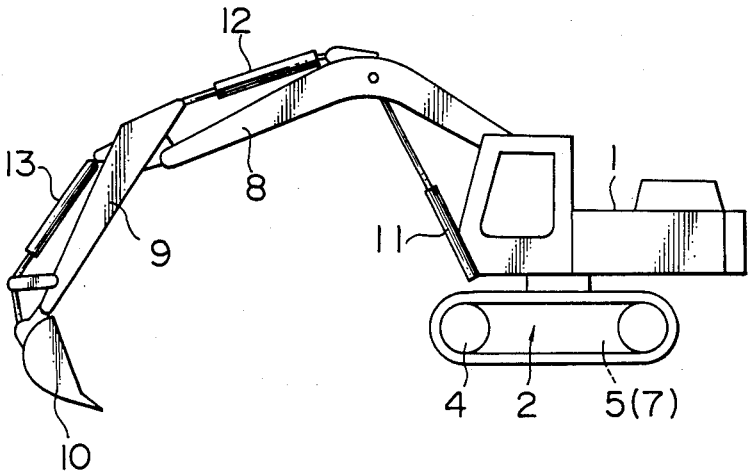
Figure 2:
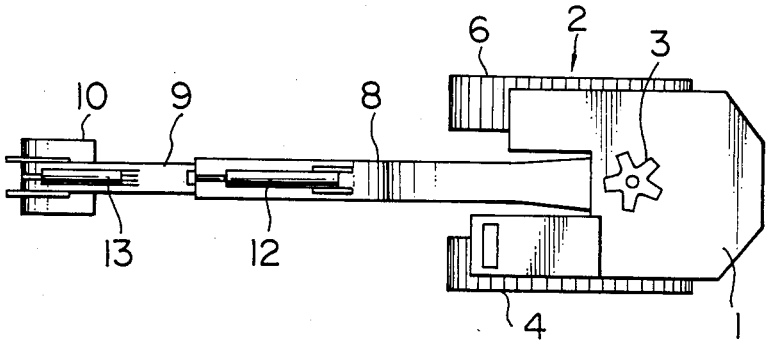
FIG. 2 is a top plan view schematically showing the hydraulic excavator shown in FIG. 1.

As shown in FIGS. 1 and 2, a hydraulic excavator generally comprises an upper swing frame 1 and a lower travelling frame 2. The upper swing frame 1 is caused to rotate by a swing hydraulic motor 3 while the lower travelling frame 2 is caused to travel by driving a pair of crawlers 4 and 6 disposed on opposing sides of the lower frame 2 by means of corresponding travel hydraulic motors 5 and 7. A boom 8 is pivotally supported by the upper swing frame 1, an arm 9 is pivotally supported by the boom 8, and a bucket 10 is pivotally supported by the arm 9. The boom 8, the arm 9 and the bucket 10 are driven by a boom cylinder 11, an arm cylinder 12 and a bucket cylinder 13, respectively.

Figure 3:
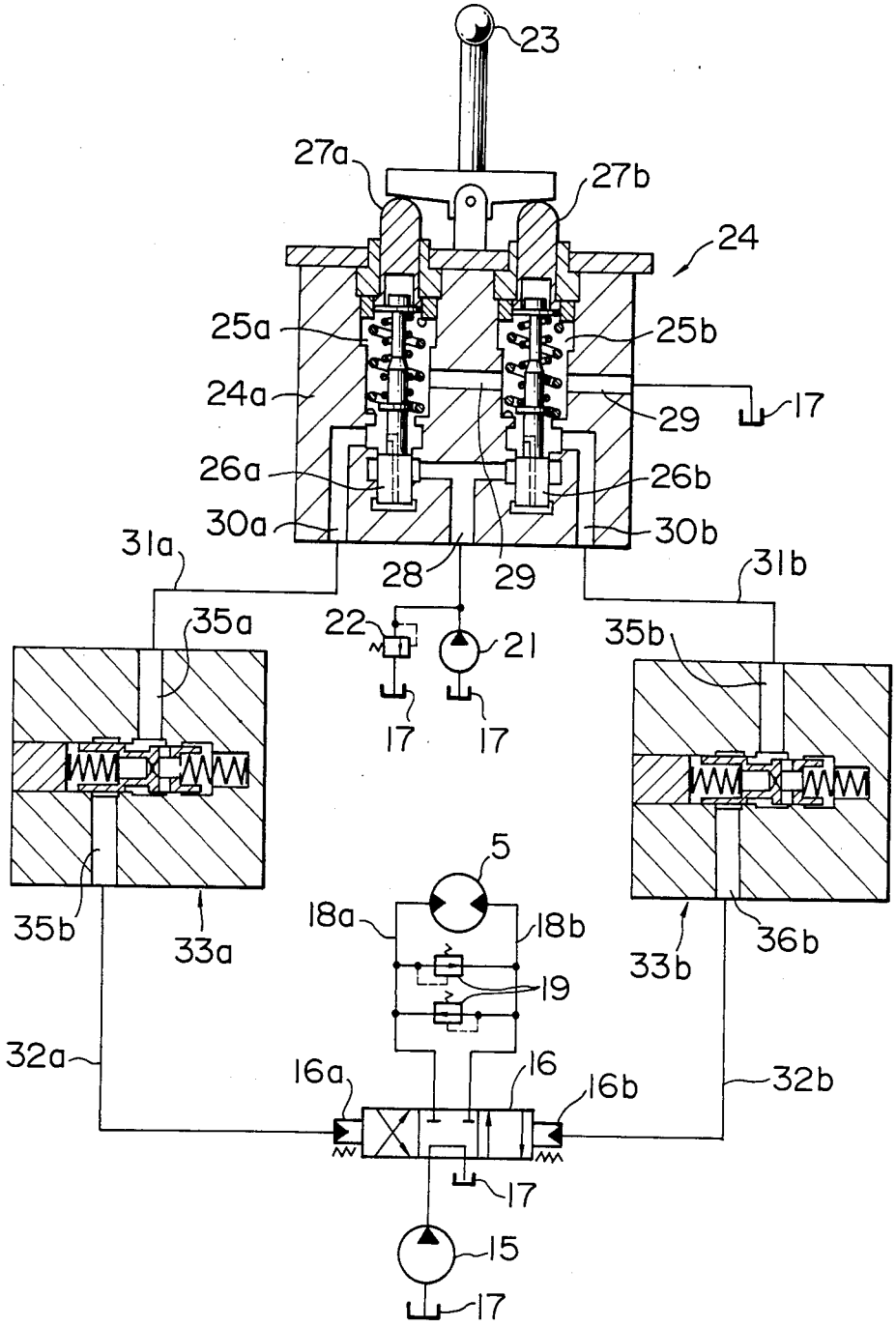
FIG. 3 is a circuit diagram schematically showing a first preferred embodiment of the pilot hydraulic system of this invention, also illustrating an example in which the embodiment is applied to the directional control valve for use with a travel motor incorporated in the hydraulic excavator shown in FIG. 1.

FIG. 3 diagrammatically shows an example of the use of a first embodiment of the pilot hydraulic system of the present invention in a directional control valve for controlling the motion of the travel motor 5 incorporated in such a hydraulic excavator. In FIG. 3, reference numeral 15 denotes a hydraulic pump incorporated in the hydraulic excavator. The hydraulic pump 15 is connected to the travel motor 5 through a directional control valve 16, which is arranged to control the supply of hydraulic fluid from the hydraulic pump 15 to the travel motor 5. A pair of pilot chambers 16*a* and 16*b* are disposed at opposing ends of the directional control valve 16. In FIG. 3, reference numeral 17 denotes reservoir for storing hydraulic fluid. A pair of main lines 18*a* and 18*b* are so disposed as to connect the directional control valve 16 and the travel motor 5, and a pair of cross-over relief valves 19 are connected between the main lines 18*a* and 18*b*.

Reference numeral 21 denotes a pilot hydraulic fluid pump, and the maximum delivery pressure of the pump 21 is restricted by a relief valve 22. The pilot hydraulic fluid pump 21 is connected to a pilot valve 24 operated by a operating lever 23 which controls the motion of the travel motor 5. The pilot valve 24 has a known structure. In brief, the valve 24 comprises: a valve body 24*a*; two valve chambers 25*a* and 25*b* formed in the valve body 24*a*; spools 26*a* and 26*b* inserted in the valve chambers 25*a* and 25*b*, respectively; and rods 27*a* and 27*b* connected to the spools 26*a* and 26*b*, respectively. The valve body 24*a* further includes passages 28, 29, 30*a* and 30*b* forming communication with the valve chambers 25*a* and 25*b*. The passage 28 connects each of the valve chambers 25*a*, 25*b* to the pilot hydraulic pump 21 and the passage 29 connects each of the valve chambers 25*a*, 25*b* to one of the reservoir 17. The passages 30*a* and 30*b* are respectively connected to the pilot chambers 16*a* and 16*b* of the directional control valve 16 through pilot lines 31*a*, 32*a* and 31*b*, 32*b*, respectively.

As shown, flow control valves 33*a* and 33*b*, each constituted as a pressure compensation valve which forms a constituent feature of the present invention, are disposed between the pilot lines 31*a* and 32*a* and the pilot lines 31*b* and 32*b*, respectively.

Figure 4:
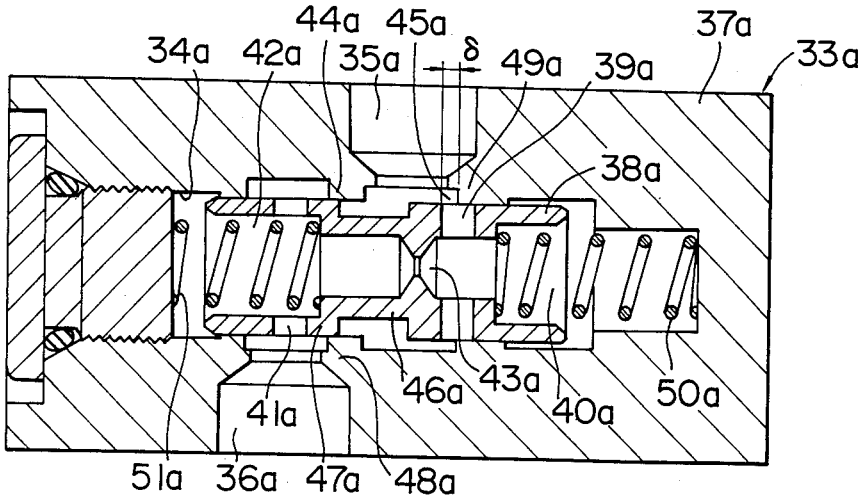
FIG. 4 is a diagrammatic enlarged sectional view of one of the flow control valves shown in FIG. 3.

The detailed structure of the flow control valves 33*a* and 33*b* will now be described with reference to FIG. 4. FIG. 4 solely shows the flow control valve 33*a*, but, since the other flow control valve 33*b* has the same structure as the valve 33*a*, the illustration and description of the valve 33*b* is omitted for the sake of simplicity.

As shown in FIG. 4, the flow control valve 33*a* has a valve body 37*a* including a valve chamber 34*a* and first and second ports 35*a* and 36*a* which are so formed as to open into the valve chamber 34*a*. The first port 35*a* is connected to the pilot line 31*a* joined to the passage 30*a*. of the flow control valve 24 while the second port 36*a* is connected to the line 32*a* joined to the pilot chamber 16*a* of the directional control valve 16. A spool 38*a* is slidably inserted into the valve chamber 34*a* of the valve body 37*a*, and the spool 38*a* is provided with a first hydraulic chamber 40*a*, a second hydraulic chamber 42*b* and a flow restriction 43*a*. The first hydraulic chamber 40*a* forms communication with the first port 35*a* through a first side hole 39*a*, the second hydraulic chamber 42*a* forms communication with the second port 36*a* through a second side hole 41*a*, and the flow restriction 43*a* is interposed between the first and second chambers 40*a* and 42*a*. The flow restriction 43*a* functions to provide communication between these chambers 40*a* and 42*a* and to produce a pressure differential between the chambers 40*a* and 42*a* while hydraulic fluid is allowed to flow through the flow restriction 43*a*, thereby causing a displacement of the spool 38*a*. The outer wall of the spool 38*a* and the inner wall of the valve chamber 34*a* constitute a shutter means 44*a* which is adapted to open as the result of the displacement of the spool 38*a* caused by the above-mentioned pressure differential, only when a hydraulic fluid is flowing in through the first port 35*a*, thereby providing communication between the first and second ports 35*a* and 36*a*. A portion of the outer wall of the spool 38*a* on the side of the first hydraulic pressure chamber 40*a* of the spool 38*a* and the inner wall of the valve chamber 34*a* constitute a control orifice 45*a* having an opening area which can be reduced by the displacement of the spool 38*a* caused by the pressure differential in proportion to the level of the pressure differential only when a hydraulic fluid is flowing in from the second port 38*a*. The control orifice 45*a* thereby maintains at a constant level the rate of hydraulic fluid flowing from the second port 36*a* to the first port 35*a* through the second hydraulic chamber 42*a*, the flow restriction 43*a* and the first hydraulic chamber 40*a*.

In the illustrated embodiment, the flow restriction 43*a* is formed in the shape of an orifice. In the same embodiment, the shutter means 44*a* is constituted by an annular groove 46*a* formed around the outer wall of the spool 38*a* and a part of the inner wall of the valve chamber 34*a*, which consists of a first land 48*a* capable of coming into contact with only a shoulder portion 47*a* formed on the side of the annular groove 46a adjacent to the second port 36a. Therefore, the annular groove 46a is consistently kept in communication with the first port 35a at all times, while the communication between the groove 46a and the second port 36a is cut off by the contact between the shoulder 47a and the land 48a except when a hydraulic fluid is flowing in from the first port 35a. Only when a hydraulic fluid is flowing in from the first port 35a, the spool 38a is displaced by the pressure differential produced by this inflow, and the shoulder 47a is moved out of contact with the land 48a, thereby providing communication between the annular groove 46a and the second port 36a. The control orifice 45a includes the first side hole 39a and a second land 49a formed on the inner wall of the valve chamber 34a so as to partially close the hole 39a.

First and second opposed springs 50a and 51a, which are partially received by the first and second hydraulic chambers 40a and 42a, respectively, are disposed, within the spaces defined between the opposed inner ends of the valve chamber 34a and the opposed outer ends of the spool 38a. The first spring 50a has a relatively strong resilient force while the second spring 51a has a relatively weak resilient force.

Figure 5:
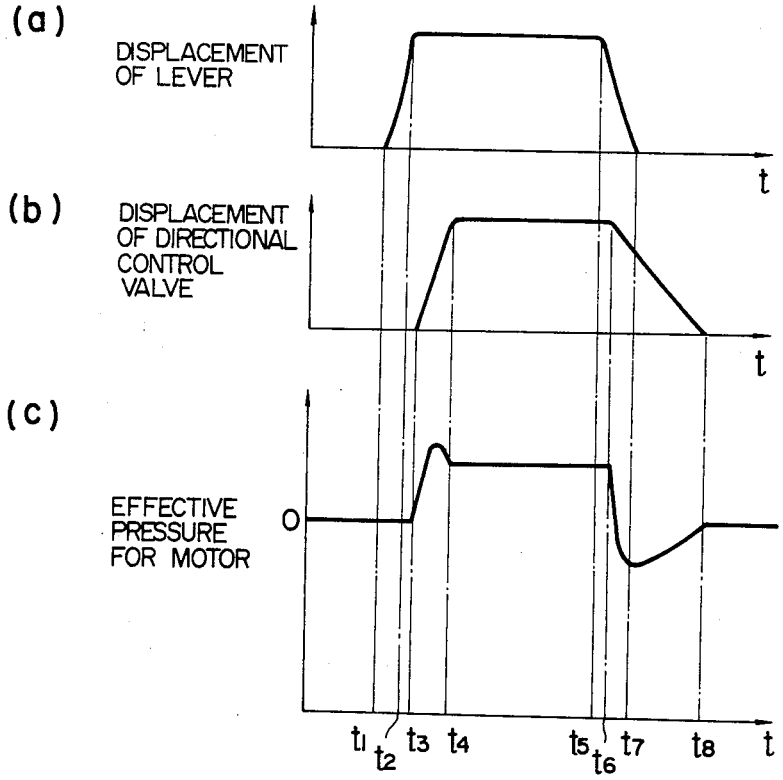
FIGS. 5(*a*), 5(*b*) and 5(*c*) respectively are timing charts used as an aid to explaining the operation of the pilot hydraulic system shown in FIG. 3.

The operation of the first preferred embodiment will be described below, with particular reference to the timing charts shown in FIGS. 5(*a*), 5(*b*) and 5(*c*).

It is assumed here that an operator makes the operating lever 23 fall to the left as viewed in FIG. 3. As will be evident from FIG. 3, the spool 26a is shifted in the pilot valve 24 in such a manner that the hydraulic fluid supplied from the pilot valve 24 passes through the passage 28, the valve chamber 25a and the passage 30a, thus flowing into the first port 35a of the flow control valve 33a through the pilot line 31a. Referring again to FIG. 4, this hydraulic fluid flows through the first port 35a, the side hole 39a, the first hydraulic chamber 40a, then into the second hydraulic chamber 42a through the flow restriction 43a, and is thus discharged into the second port 36a through the side hole 41a. At this point, a pressure differential occurs between the first and second hydraulic chambers 40a and 42a disposed on opposing sides of the flow restriction 43a. When this differential pressure exceeds the resilient force of the spring 51a, the spool 38a is shifted from the illustrated neutral position to the left as viewed in FIG. 4. Therefore, the shoulder 47a of the spool 38a is moved out of contact with the land 48a, and thus the annular groove 46a of the spool 38a forms communication with the second port 36a, thereby allowing hydraulic fluid to flow from the first port 35a to the second port 36a through the annular groove 46a. Since the spring 51a is selected to have a weak force, the leftward movement of the spool 38a takes place shortly after hydraulic fluid has entered the first port 35a, so that the flow of hydraulic fluid from the first port 35a to the second port 36a is changed into a free flow with no limitations.

The hydraulic fluid entering the second port 36a is supplied to the pilot chamber 16a of the directional control valve 16 through the pilot line 32a. In consequence, the directional control valve 16 is actuated at a time $t_3$ in FIG. 5(*b*), and subsequently reaches a maximum degree of displacement at a time $t_4$ The time $t_4$ is somewhat later than that of a conventional type of hydraulic system which has no flow control valve, and this time lag will be described later.

When the directional control valve 16 is driven from the neutral position to the left-hand position, the hydraulic fluid from the hydraulic pump 15 is supplied to the travel motor 5 through the directional control valve 16 and the main line 18b. The effective pressure within the travel motor 5 increases as shown in FIG. 5(*c*), and thus the travel motor 5 starts to operate. After the time $t_4$, the travel motor 5 continues its regular operation so as to move the hydraulic excavator. The manner in which the effective pressure increases during the time interval between the time $t_3$ and the time $t_4$ differs from that of a prior-art hydraulic system which has no flow control valve, and this difference will also be described later.

When the operating lever 23 is returned to the neutral position at a time $t_5$, the valve chamber 25a of the pilot valve 24 forms communication with the hydraulic-fluid reservoir 17. Therefore, the first port 35a, the side hole 39a and the first hydraulic chamber 40a form communication with the reservoir 17, and thus the pressure on the side of the second hydraulic chamber 42a becomes higher than that on the side of the first hydraulic chamber 40a. The hydraulic fluid delivered to the pilot chamber 16a of the directional control valve 16 enters the flow control valve 33a through the second port 36a. This hydraulic fluid passes through the side hole 41a, the first hydraulic chamber 42a, the flow restriction 43a, the second hydraulic chamber 40a the side hole 39a and the first port 35a, then flows into the hydraulic-fluid reservoir 17 via the pilot line 31a and the pilot valve 24. During this sequence of hydraulic flow, when the flow rate of the hydraulic fluid passing through the flow restriction 43a increases and the differential pressure generated between the first and second hydraulic chambers 40a and 42a on opposing sides of the flow restriction 43a becomes larger than the resilient force of the spring 50a, the spool 38a moves to the right as viewed in FIG. 4. The opening area $\delta$ of the control orifice 45a constituted by the side hole 39a and the land 49a is thereby reduced, limiting the flow rate of hydraulic fluid from the first hydraulic chamber 40a to the first port 36a through the control orifice 45a. Thus, the differential pressure between the first and second chambers 40a and 42a is maintained at a constant level, and hydraulic fluid flows out of the first hydraulic chamber 40a at a constant rate. In this state, if the pressure of the hydraulic fluid entering the second port 36a increases, the opening area $\delta$ is further reduced, so that the differential pressure is maintained at a constant level. Conversely, if the pressure of the hydraulic fluid entering the second port 36a drops, the opening area $\delta$ is enlarged, so that the differential pressure is still maintained at a constant level.

Specifically, a fixed rate of hydraulic fluid flows consistently from the pilot chamber 16a through the pilot line 32a, passing through the flow control valve 33a and the pilot line 31a, and is discharged into the hydraulic fluid reservoir 17 through the pilot valve 24. Therefore, as shown in FIG. 5(*b*), even if the operating lever 23 is quickly returned to the neutral position, the directional control valve 16 is restored to the neutral position at a time $t_8$ which is even later than a time $t_7$ owing to the slow changing speed of the valve 16 per se.

Since the speed at which the directional control valve 16 is restored to the neutral position is limited in the above-described fashion, the main lines 18a and 18b are not closed quickly. Therefore, as shown in FIG. 5(*c*), the brake pressure generated within the main line 18a slowly increases. As a result, it is possible to greatly reduce the level of impact applied to the entire frame of the hydraulic excavator when it is stopped, so that the operability and durability of the excavator are improved, thus leading to a decrease in operator fatigue.

The following description concerns the time $t_4$ at which the directional control valve 16 completes its changing operation later than the shifting of the operating lever 23 from the neutral position. As previously described, when the operating lever 23 is made to fall leftward, the directional control valve 16 starts its changing operation at the time $t_3$. In this case, no substantial pressure loss occurs within the flow control valve 33*a*. When the directional control valve 16 starts its changing operation, the hydraulic fluid present within the pilot chamber 16*b* of the directional control valve 16 and the pilot line 32*b* is forced to pass through the flow control valve 33*b*, the pilot line 31*b*, and the pilot valve 24, and is discharged into the hydraulic-fluid reservoir 17. In this case, the hydraulic fluid flowing from the second port 36*b* of the flow control valve 33*b* to the first port 35*b* thereof is limited, as mentioned previously in the description of the flow control valve 33*a* (the second port 36*a* corresponds to the second port 36*b* of the flow control valve 33*a* while the first port 35*b* corresponds to the first port 35*b* of the flow control valve 33*a*). For that reason, the time $t_4$ at which the directional control valve 16 reaches the maximum degree of displacement is later when using the flow control valve 33*b* than when using no valve 33*b*. In this case, however, at the time $t_3$ when the directional control valve 16 starts its changing operation, the pilot chamber 16*b* has already formed communication with the hydraulic-fluid reservoir 17. In this state, even if hydraulic fluid is forced out of the pilot chamber 16*b* when the directional control valve 16 is switched, the flow rate of this hydraulic fluid is regulated by the compressibility of both the hose which constitutes the pilot line and the fluid per se, and thus the fluid passe through the flow restriction 43*a* of the flow control valve 33*b* (corresponding to the flow restriction 43*a* of the flow control valve 33*a*) at a reduced rate. Therefore, since there is a small difference between the pressure levels produced on the opposing sides of the flow restriction 43*a*, the flow of hydraulic fluid is only limited to a small extent. However, a certain level of limitation per se is actually present, even though it may be small. This limitation acts to reduce the speed at which the directional control valve 16 is switched. In consequence, as can be seen from FIG. 5(*c*), the pressure of the hydraulic fluid supplied through the main line 18*b* to the travel motor 5 shows slow-rise characteristics, whereby it is possible to reduce the level of impact produced when the travel motor 5 is started.

As described above, in the first preferred embodiment, since the flow control valve is interposed between the two pilot lines connecting the pilot valve to the directional control valve, it is possible to reduce the impact generated when the travel motor is started and stopped. Moreover, the operability and durability of the mechanism are improved and the level fatigue experienced by the operator can be reduced.

In this embodiment, since the flow control valves, each constituted as a pressure compensation valve, are inserted into the hydraulic system, if the pressure of hydraulic fluid is caused to fluctuate due to the fluctuations in the load applied on the hydraulic actuator when the fluid flows into the second port, a constant rate of hydraulic fluid can be maintained, thereby enabling the stoppage of the travel motor to occur in a stable manner, as compared with prior-art hydraulic systems.

Furthermore, in this illustrated embodiment, since the flow of hydraulic fluid is limited during the flow of hydraulic fluid into the second port by both the orifice serving as a flow restriction for generating differential pressure and the control orifice, each of these orifices can be selected such as to have a relatively large opening area, and thus there is no risk of the orifices becoming clogged with impurities such as dirt contained in the fluid. Also, the provision of these orifices enables a reduction in the pressure loss which occurs when the fluid flows through the orifices, eve if the viscosity of the fluid increases at low temperatures, whereby it is possible to achieve a function of compensating for pressure change so as to maintain the same at a constant level.

In addition, according to the first preferred embodiment, the shutter means and the control orifice of the flow control valve are constituted by the outer wall of the spool and the inner wall of the valve chamber in which the spool slides. This construction results in remarkable simplification of the structure of the flow control valve and a reduction in manufacturing costs.

Figure 6:
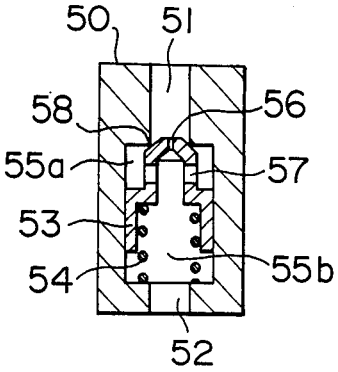
FIG. 6 is a diagrammatic sectional view of a flow control valve constituting a part of a second preferred embodiment of the pilot hydraulic system in accordance with the present invention.

FIG, 6 is a diagrammatic, sectional view of a flow control valve for use in the second preferred embodiment of a pilot hydraulic system incorporating a directional control valve for controlling the direction of rotation of the travel motor in accordance with the present invention. In FIG. 6, reference numeral 50 generally denotes a flow control valve and the respective flow control valves 50 are disposed between the pilot lines 31*a*, 32*a* and 31*b*, 32*b*, instead of the flow control valves 33*a* and 33*b* used in the first embodiment of the present invention, each having a pressure compensation function. A first port 51 is connected to each of the pilot lines 31*a* and 31*b*, a second port 52 being connected to the pilot lines 32*a* and 32*b*. The flow control valve 50 further includes: a spool 53; a spring 54 for biasing the spool 53; first and second hydraulic chambers 55*a* and 55*b*; a choke-shaped restriction 56 formed in the tip of the spool 53; a hole 57 formed in the body of the spool 53 so as to provide communication between the first and second hydraulic chambers 55*a* and 55*b*; and a valve seat 58.

The flow control valve 50 having the above-described construction may be substituted for each of the flow control valves 33*a* and 33*b* each having a pressure compensation function in the hydraulic system illustratively shown in FIG. 3. In operation, when the operating lever 23 is made to fall to the left as viewed in the Figure, the hydraulic fluid delivered from the pilot hydraulic pump 21 is supplied to the first port 51 of the flow control valve 50 through the pilot valve 24 and the pilot line 31*a*. Thus, since the spool 53 is pushed downward as viewed in FIG. 6 against the resilient force of the spring 54, the hydraulic fluid is allowed to pass through the first port 51, the first hydraulic chamber 55*a*, the hole 57, the second hydraulic chamber 55*b*, and the second port 52, and thus flows into the pilot chamber 16*a* of the directional control valve 16 through the pilot line 32*a*. In this case, no substantial pressure loss occurs within the flow control valve 50. When the directional control valve 16 start its changing operation, the fluid within the pilot chamber 16*b* may pass through the pilot line 32*b*, the flow control valve 50, the pilot line 31*b*, and is discharged into the reservoir 17 through the pilot valve 24. During this time, since the fluid within the flow control valve 50 passes through the flow restriction 56, the switching speed of the directional control valve 16 is made slightly slower, thereby reducing the level of impact applied when the travel motor 5 is actuated.

When the operating lever 23 is returned to the neutral position so as to stop the travel motor 5, the fluid within the pilot chamber 16*a* and the pilot line 32*a* is made to flow into the second port 52 of the flow control valve 50, and thus the tip of the spool 53 is forced against the valve seat 58. In consequence, the hydraulic fluid is allowed to flow into the first port 51 through the flow restriction 56 alone, passing through the pilot line 31*b*, and then being discharged into the hydraulic fluid reservoir 17 through the pilot valve 24. In this fashion, the rate of return of the hydraulic fluid is limited by the flow restriction 56 and the speed of restoration of the directional control valve 16 is made slow. This hydraulic mechanism acts to allow a slow rise in the brake pressure within the main line 18*a*, thereby greatly reducing the level of impact generated when the travel motor 5 is stopped.

In this fashion, since the second preferred embodiment is arranged in such a manner that each of the flow control valves is disposed between the two pilot lines which connect the pilot valve to the directional control valve, this embodiment has the same advantage as that of the first embodiment in that it is possible to reduce the impact produced when the travel motor is actuated and stopped. In addition, the manufacturing costs can be further reduced thanks to the simple structure of the flow control valve.

Figure 7:
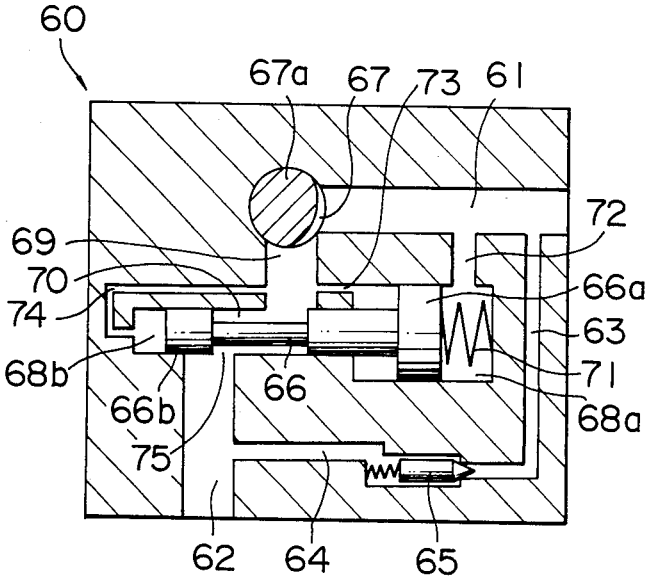
FIG. 7 is a diagrammatic sectional view of a flow control valve constituting a part of a third preferred embodiment of the pilot hydraulic system in accordance with the present invention.

Referring to FIG. 7, the third preferred embodiment of the present invention will be described below. In FIG. 7, reference numeral 60 generally denotes a known flow control valve having a pressure compensating function, the structure of which differs from that of the flow control valve 33*a* having a pressure compensating function shown in FIG. 4. The flow control valves 60 are disposed between the pilot lines 31*a*, 32*a* and 31*b*, 32*b*, respectively, instead of the flow control valves 33*a*, 33*b* of the pilot hydraulic system shown in FIG. 3. The flow control valve 60 includes first and second ports 61 and 62, the first port 61 being connected to the pilot lines 31*a* and 31*b* with the second port 92 being connected to the pilot lines 32*a* and 32*b*. The first and second ports 61 and 62 are connected with each other through passages 63 and 64 extending to the ports 61 and 62, respectively, and through a pressure compensating portion disposed in parallel to the passages 63 and 64. A check valve 65 is disposed between the passages 63 and 64 which only allow the flow of hydraulic fluid from the first port 61 to the second port 62. The pressure compensating portion includes a spool 66 and an orifice 67. The spool 66 has a large-diameter end portion 66*a* and a small-diameter end portion 66*b* which are slidably inserted into first and second hydraulic chambers 68*a* and 68*b*, respectively. An intermediate chamber 70 is formed between the first and second hydraulic chambers 68*a* and 68*b* in such a manner that the chamber 70 forms communication with the second port 62 and an interior passage 69. A spring 71 is disposed within the outer space of the first hydraulic chamber 68*a*, that is, the space defined between the end of the large-diameter portion 66*a* and the end wall of the first hydraulic chamber 68*a* nearer the passage 63. This outer space forms communication with the first port 61 through the passage 72. The inner space of the first hydraulic chamber 68*a*, that is, the space on the side of the large-diameter portion 66*a* opposite to the outer space and the second hydraulic chamber 69 form communication with the interior passage 69 through the passages 73 and 74, respectively. The orifice 67 is disposed at a junction of the interior passage 69 and the first port 61. The orifice 67 is disposed as a cresent-shaped groove formed around the periphery of a manually-rotatable rod 67*a*. The rod 67*a* is rotated in order to shift the position of the groove, thereby adjusting the opening area of the orifice 67.

In the flow control valve 60, the hydraulic fluid entering the first port 61 is allowed to flow into the passage 63, moving the check valve 65, and thus flows into the second port 62 through the passage 64. Conversely, when hydraulic fluid is made to flow into the second port 62, the hydraulic fluid flows into the first port 61 through the intermediate chamber 70, the interior passage 69 and the orifice 69. During this time, since the hydraulic fluid passes through the orifice 67, a differential pressure is produced between the interior passage 69 and the first port 61. The thus-produced differential pressure is transmitted to the first and second hydraulic chambers 68*a* and 68*b*, and thus the spool 66 is made to shift rightward as viewed in FIG. 7 in proportion to the level of the differential pressure transmitted. This rightward displacement of the spool 66 reduces the opening area of an orifice 75 formed between the small-diameter portion 66*b* and an opening of the intermediate chamber 70 into which the second port 62 extends. Accordingly, the rate of hydraulic fluid flowing from the second port 62 to the first port 61 is maintained at a constant level.

As will be evident from the foregoing statement, if the flow control valve 60 having a pressure compensating function is substituted for each of the flow control valves 33*a* and 33*b*, it is possible to achieve substantially the same effect as that of each of the flow control valves 33*a* and 33*b*.

Although the description of each of the preferred embodiments illustratively refers to the directional control valve used for controlling the travel motor incorporated in the hydraulic excavator, the present invention is not in any sense limited to the illustrated embodiments. It is evident that the present invention can be adapted to various directional control valves for actuators incorporated in a variety of working machines. While a flow control valve is inserted in each of the two pilot lines in both the illustrated embodiments, a single valve may be disposed in just one of these pilot lines in appropriate circumstances various conditions under which the actuator is operated, depending on the load.

Also, while the directional control valve having a pair of opposed pilot chambers is illustratively explained in the description of each of the embodiments, the explanation above is not exclusive. The present invention can be adapted to a directional control valve of the type in which a pilot chamber is disposed at one end of the valve with the other end being simply biased by spring means.

It will be appreciated from the foregoing that, since the present invention is arranged such that the flow control valve is disposed in the pilot lines connecting the pilot valve to the directional control valve, it is possible to reduce the level of impact occurring when the hydraulic actuator is stopped, whereby the operability and durability of the system are improved, leading to a reduction in operator fatigue.

What is claimed is:

1. A pilot hydraulic system comprising:

a directional control valve connected to a hydraulic actuator through main lines and having at least one pilot chamber for controlling the operation of the hydraulic actuator; and a pilot valve connected through a pilot line to said pilot chamber of said directional control valve for operation thereof;

wherein said pilot line includes a flow control valve which allows a free flow of hydraulic fluid from said pilot valve to said directional valve while limiting a flow of hydraulic fluid from said directional control valve to said pilot valve.

2. A pilot hydraulic system according to claim 1, wherein said directional control valve includes a pair of opposed pilot chambers, said pilot valve being connected to said pilot chambers through the respective pilot lines, and said flow control valve is connected in at least one of said pilot lines.

3. A pilot hydraulic system according to claim 2, wherein said flow control valve is connected in each of said pilot lines.

4. A pilot hydraulic system according to claim 1, wherein said flow control valve is a pressure compensation valve.

5. A pilot hydraulic system according to claim 1, wherein said flow control valve includes:

a valve body having a valve chamber and first and second ports opening into said valve chamber;

a spool slidably inserted in said valve chamber of said valve body, and having first and second hydraulic chambers communicating with said first and second ports, respectively, and a restriction disposed between said first and second hydraulic chambers so as to provide communication therebetween and generate a differential pressure therebetween to cause a displacement of said spool when hydraulic fluid is flowing through the restriction;

shutter means constituted by an outer wall of said spool and an inner wall of said valve chamber in combination, said shutter means being so arranged as to be opened by the displacement of said spool caused by said differential pressure only when hydraulic fluid is flowing in from said first port, thereby providing communication between said first port and said second port;

a control orifice constituted by a portion of said spool on the side of said first hydraulic chamber and the inner wall of said valve chamber, said control orifice being so arranged to reduce an opening area thereof by the displacement of said spool caused by said differential pressure in proportion to the level of said differential pressure, only when hydraulic fluid is flowing in from said second port, thereby maintaining at a constant level the flow rate of hydraulic fluid flowing from said second port to said first port through said second hydraulic chamber, said restirction and said first hydraulic chamber.

6. A pilot hydraulic system according to claim 5, wherein said restriction is an orifice.

7. A pilot hydraulic system according to claim 5, wherein said shutter means includes: an annular groove formed around the outer wall of said spool; and a first land formed on the inner wall of said valve chamber to be in contact with a shoulder of said annular groove adjacent to said second port, said annular groove being arranged in such a manner that said groove is in communication with said first port at all times and out of communication with said second port by the contact between said shoulder and said first land except when hydraulic fluid is flowing in from said first port but is brought into communication between said second port by said shoulder moved out of contact with said land as a result of the displacement of said spool caused by said differential pressure only when hydraulic fluid is flowing in from said first port.

8. A pilot hydraulic system according to claim 5, wherein said first and second hydraulic chambers are in communication with said first and second ports through first and second side holes formed in said spool, respectively, said control orifice including said first side hole and a second land formed on the inner wall of said valve chamber so as to partially close said side hole.

9. A pilot hydraulic system according to claim 5, wherein first and second opposed springs are arranged adjacent said first and second hydraulic chambers of said spool, respectively, said first spring being selected to have a relatively strong resilient force while said second spring is selected to have a relatively weak resilient force.

* * * * *